US007620360B2

(12) United States Patent
Heydinger et al.

(10) Patent No.: US 7,620,360 B2
(45) **Date of Patent: *Nov. 17, 2009**

(54) METHOD FOR REDUCING SHOW-THROUGH IN A SCANNED DUPLEXED DOCUMENT

(75) Inventors: Scott Heydinger, Lexington, KY (US); William Everette Gardner, Louisville, KY (US); Khageshwar Thakur, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 604 days.

This patent is subject to a terminal disclaimer.

(21) Appl. No.: 11/277,882

(22) Filed: Mar. 29, 2006

(65) Prior Publication Data

US 2006/0263126 A1 Nov. 23, 2006

Related U.S. Application Data

(63) Continuation-in-part of application No. 11/133,524, filed on May 20, 2005.

(51) Int. Cl.
*G03G 15/00* (2006.01)

(52) U.S. Cl. ..... 399/374; 399/364

(58) Field of Classification Search ..... 358/3.26, 358/401; 399/364, 374

See application file for complete search history.

(56) References Cited

U.S. PATENT DOCUMENTS 5,646,744 A * 7/1997 Knox ..... 358/401
5,710,957 A 1/1998 Acquaviva
5,832,137 A * 11/1998 Knox ..... 382/275
5,973,792 A 10/1999 Matsuda
6,101,283 A * 8/2000 Knox ..... 382/254
6,185,012 B1 2/2001 Yun
6,215,492 B1 4/2001 Okuyama et al.
6,219,158 B1 4/2001 Dawe
6,288,798 B1 9/2001 Sharma
6,498,867 B1 12/2002 Potucek et al.
6,647,144 B2 11/2003 Williams et al.
6,667,756 B2 12/2003 Conrow et al.
6,707,583 B1 3/2004 Tsai et al.
6,753,984 B1 6/2004 Wada
6,806,896 B2 10/2004 Conrow et al.
6,862,117 B1 3/2005 Ford et al.
6,877,659 B2 4/2005 Abramsohn
2002/0071131 A1* 6/2002 Nishida ..... 358/1.9
2006/0263125 A1* 11/2006 Gardner et al. ..... 399/364
2006/0263126 A1* 11/2006 Heydinger et al. ..... 399/364
2007/0231031 A1* 10/2007 Heydinger et al. ..... 399/374

* cited by examiner

*Primary Examiner*—Twyler L Haskins
*Assistant Examiner*—David L Suazo
(74) *Attorney, Agent, or Firm*—Taylor & Aust

(57) ABSTRACT

A method for processing a duplexed document having a first side with a first image and a second side with a second image includes scanning only the first side of the duplexed document under a first imaging condition to retrieve first information relating to each of the first image and show-through contribution of the second image; scanning only the first side of the duplexed document under a second imaging condition to retrieve second information relating to each of the first image and show-through contribution of the second image; and comparing the first information and the second information to reduce an amount of the show-through contribution.

20 Claims, 10 Drawing Sheets

METHOD FOR REDUCING SHOW-THROUGH IN A SCANNED DUPLEXED DOCUMENT

This is a continuation-in-part of U.S. patent application Ser. No. 11/133,524, filed May 20, 2005, entitled "Method for Processing a Duplexed Document" and assigned to the assignee of the present application. This application is related to U.S. patent application Ser. No. 11/277/859, filed Mar. 29, 2006, entitled "Method for Performing Duplex Copying" and assigned to the assignee of the present application.

BACKGROUND OF THE INVENTION

1. Field of the Invention

The present invention relates to a method for processing a duplexed document, and, more particularly, to a method for reducing show-through in a scanned duplexed document.

2. Description of the Related Art

Consumers may utilize a simple photocopying device to make copies of documents coming from a variety of sources which include a variety of mass print media, such as magazines and newspapers. Due to the large volume of these materials, magazine and newspaper producers typically print on low cost, low-grade thin paper stock. To further control costs, the media, e.g., paper, are typically printed in a duplex fashion, i.e., content is printed on both sides of the media, which will be referred to herein as a "duplexed document." As used herein, the term "front side" is used to refer to the side of the media that is facing the scanner of the photocopying device, and the "back side" is the side of the media opposite to the front side.

Due to the thinness of low-cost media, such media are not completely opaque. Therefore, in addition to sensing the intended document information from the front side of the duplexed document, the scanner sensor of the photocopying device may also sense document content that is printed on the back side of the duplexed document. The photocopy will therefore include both intended information, and unintended information commonly referred to as "show-through."

A known technique for detecting the show-through effect requires the user to scan both sides of the document. Once the pixel locations of undesirable show-through image information have been detected, methods of removal of the back-side show-through information from the front-side desired document can then be employed.

Such techniques have multiple drawbacks. For example, one drawback is that the duplexed document must be flipped over to face the scanner sensor, requiring either the use of complex and expensive duplexing hardware, or an undesirable user intervention to provide the necessary document flipping. As another example, such a technique typically requires a complicated algorithm to then spatially correlate the dual-side scanned information to account for both the horizontally flipped relationship between the two scans and the misalignment of the two images.

SUMMARY OF THE INVENTION

The present invention provides a method wherein a scanned copy of a duplexed document is repaired to reduce the show-through contribution of a back-side image with respect to a front side of the duplexed document.

The invention, in one exemplary embodiment, is directed to a method for processing a duplexed document having a first side with a first image and a second side with a second image. The method includes scanning only the first side of the duplexed document under a first imaging condition to retrieve first information relating to each of the first image and show-through contribution of the second image; scanning only the first side of the duplexed document under a second imaging condition to retrieve second information relating to each of the first image and show-through contribution of the second image; and comparing the first information and the second information to reduce an amount of the show-through contribution.

The invention, in another exemplary embodiment, is directed to a method for calibrating a scanner for processing a duplexed user document having a front side with a front-side image and a back side with a back-side image. The method includes providing a duplexed calibration document having a first side with a first calibration image and a second side, opposite to the first side, with a second calibration image; scanning only the first side of the duplexed calibration document under a first imaging condition to retrieve first information relating to each of the first calibration image and the second calibration image; scanning only the first side of the duplexed calibration document under a second imaging condition to retrieve second information relating to each of the first calibration image and the second calibration image; and generating a transformation function from the first information and the second information for reducing back-side image show-through in a scanned front-side image.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
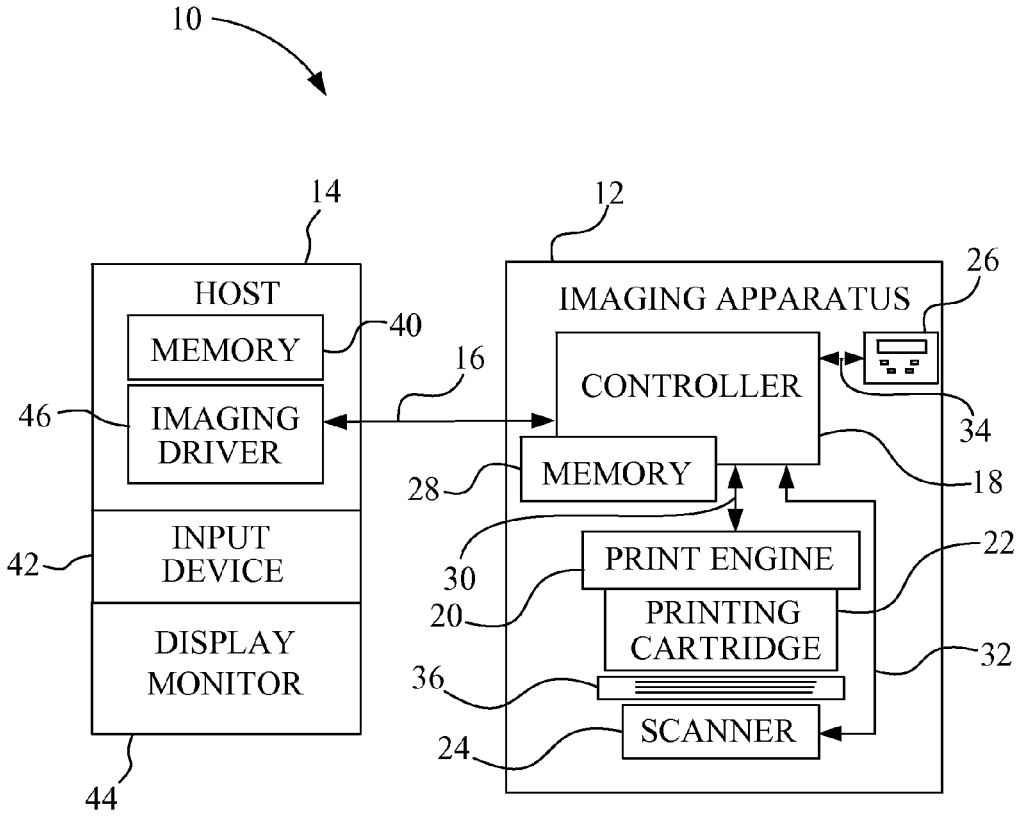
FIG. 1 is a diagrammatic depiction of an imaging system that utilizes the present invention.

Referring now to the drawings and particularly to FIG. 1, there is shown a diagrammatic depiction of an imaging system 10 embodying the present invention. Imaging system 10 includes an imaging apparatus 12 and a host 14. Imaging apparatus 12 communicates with host 14 via a communications link 16. As used herein, the term "communications link" is used to generally refer to structure that facilitates electronic communication between multiple components, and may operate using wired or wireless technology.

Imaging apparatus 12 may be, for example, an ink jet printer and/or copier, an electrophotographic printer and/or copier, a thermal transfer printer and/or copier, or an all-in-one (AIO) unit that includes a print engine, a scanner unit, and possibly a fax unit. An AIO unit is also known in the art as a multifunction machine. For example, as shown in FIG. 1, imaging apparatus 12 includes a controller 18, a print engine 20, a printing cartridge 22, a scanner unit 24, and a user interface 26. Imaging apparatus 12 may communicate with host 14 via a standard communication protocol, such as for example, universal serial bus (USB), Ethernet or IEEE 812.1x.

Controller 18 includes a processor unit and associated memory 28, and may be formed as one or more Application Specific Integrated Circuits (ASIC). Memory 28 may be, for example, random access memory (RAM), read only memory (ROM), and/or non-volatile RAM (NVRAM). Alternatively, memory 28 may be in the form of a separate electronic memory (e.g., RAM, ROM, and/or NVRAM), a hard drive, a CD or DVD drive, or any memory device convenient for use with controller 18. Controller 18 may be a printer controller, a scanner controller, or may be a combined printer and scanner controller. In the present embodiment, controller 18 communicates with print engine 20 via a communications link 30. Controller 18 communicates with scanner unit 24 via a communications link 32. User interface 26 is communicatively coupled to controller 18 via a communications link 34. Controller 18 serves to process print data and to operate print engine 20 during printing, as well as to operate scanner unit 24 and process image data obtained via scanner unit 24.

In the context of the examples for imaging apparatus 12 given above, print engine 20 can be, for example, an ink jet print engine, an electrophotographic print engine or a thermal transfer engine, configured for forming an image on a substrate 36, such as a sheet of paper, transparency or fabric. As an ink jet print engine, for example, print engine 20 operates printing cartridge 22 to eject ink droplets onto substrate 36 in order to reproduce text and/or images. As an electrophotographic print engine, for example, print engine 20 causes printing cartridge 22 to deposit toner onto substrate 36, which is then fused to substrate 36 by a fuser (not shown), in order to reproduce text and/or images.

Host 14, which may be optional, may be, for example, a personal computer, including memory 40, such as RAM, ROM, and/or NVRAM, an input device 42, such as a keyboard, and a display monitor 44. Host 14 further includes a processor, input/output (I/O) interfaces, and at least one mass data storage device, such as a hard drive, a CD-ROM and/or a DVD unit.

Host 14 includes in its memory a software program including program instructions that function as an imaging driver 46, e.g., printer/scanner driver software, for imaging apparatus 12. Imaging driver 46 is in communication with controller 18 of imaging apparatus 12 via communications link 16. Imaging driver 46 facilitates communication between imaging apparatus 12 and host 14, and may provide formatted print data to imaging apparatus 12, and more particularly, to print engine 20, to print an image.

In some circumstances, it may be desirable to operate imaging apparatus 12 in a standalone mode. In the standalone mode, imaging apparatus 12 is capable of functioning without host 14. Accordingly, all or a portion of imaging driver 46, or a similar driver, may be located in controller 18 of imaging apparatus 12 so as to accommodate printing during a copying or facsimile job being handled by imaging apparatus 12 when operating in the standalone mode.

Scanner unit 24 may be of a conventional scanner type, such as for example, a sheet feed or flat bed scanner. In the context of the present invention, in some embodiments either scanner type may be used. As is known in the art, a sheet feed scanner transports a document to be scanned past a stationary sensor device.

Figure 2:
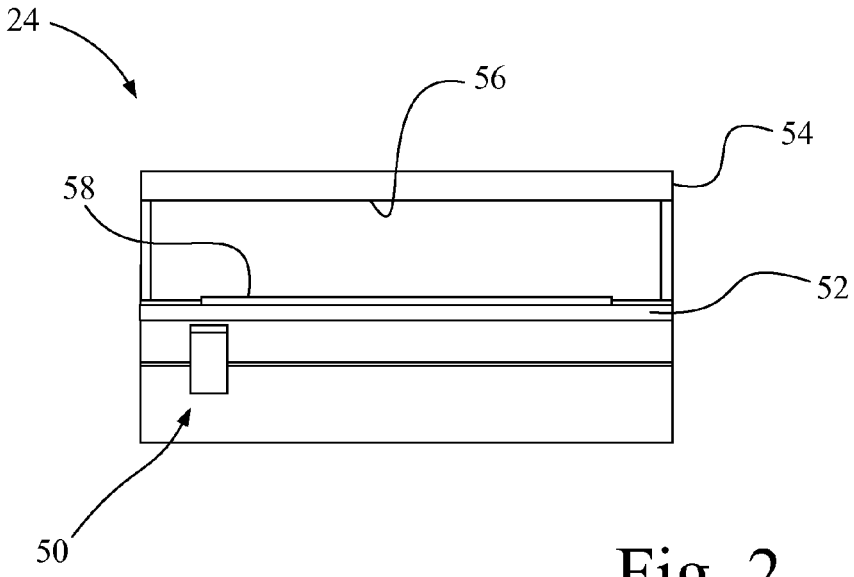
FIG. 2 is a diagrammatic representation of an embodiment of the scanner unit used in the imaging system of FIG. 1.

Referring to FIG. 2, there is shown an embodiment where scanner unit 24 is a flat bed scanner. Scanner unit 24 includes a scanning bar 50, a document glass 52 and a lid 54. FIG. 2 shows scanner unit 24 with lid 54 in an open position. Lid 54 includes a surface that forms a background 56 for a document 58 being scanned. During operation, lid 54 is lifted, document 58 to be scanned is placed on document glass 52, and in some embodiments, lid 54 is closed. Scanning bar 50, including one or more illuminants, e.g., lamps, LED arrays, etc., and including one or more sensor arrangements, then is scanned over the stationary document 58 to collect image data.

In one embodiment of the present invention, scanner unit 24 is controlled, such as by controller 18, to provide two different illumination levels. This may be achieved, for example, by adjusting the power supplied to the illuminant of scanning bar 50. Alternatively, this may be achieved, for example, by providing scanning bar 50 with two illuminants, each providing a different illumination level from the other.

In another embodiment of the present invention, scanner unit 24 is controlled, such as by controller 18, to provide two different spectral characteristics, e.g., light frequency ranges. This may be achieved, for example, by providing scanning bar 50 with two illuminants, each providing different spectral characteristics from the other.

In another embodiment of the present invention, scanning bar 50 of scanner unit 24 may include two sensor arrangements, each having different sensitivities in determining reflectivity from the other.

In another embodiment of the present invention, lid 54 may have reflectance characteristics that may be changed. For example, background 56 of lid 54 may be a surface that is highly reflective, e.g., a mirror surface or white surface, or background 56 of lid 54 may have a surface that has low reflectivity, e.g., is darkened or black. Such change in the reflectivity of background 56 may be achieved, for example, by providing background 56 as a rotatable belt having at least two different reflectance areas, or by the electronic manipulation of the background, as in the case of an electronic element array forming background 56.

The present invention detects locations of a scanned image corresponding to undesired show-through information, without having to scan both sides of the duplexed document. The present invention addresses the fact that different areas of a duplexed document may be affected differently by the show-through contribution of a back-side image. For example, consider two different pixel areas having different light intensities, yet measuring the same pixel value. One pixel value $g_1$ might result from scanning an image area with only information on the front side. Another area of the document may have a genuine shade of pixel value $g_2$ lighter than pixel value $g_1$, but still measure as pixel value $g_1$ instead of pixel value $g_2$ due to the presence of some image information on the back that has the effect of artificially darkening pixel value $g_2$.

Figure 3:
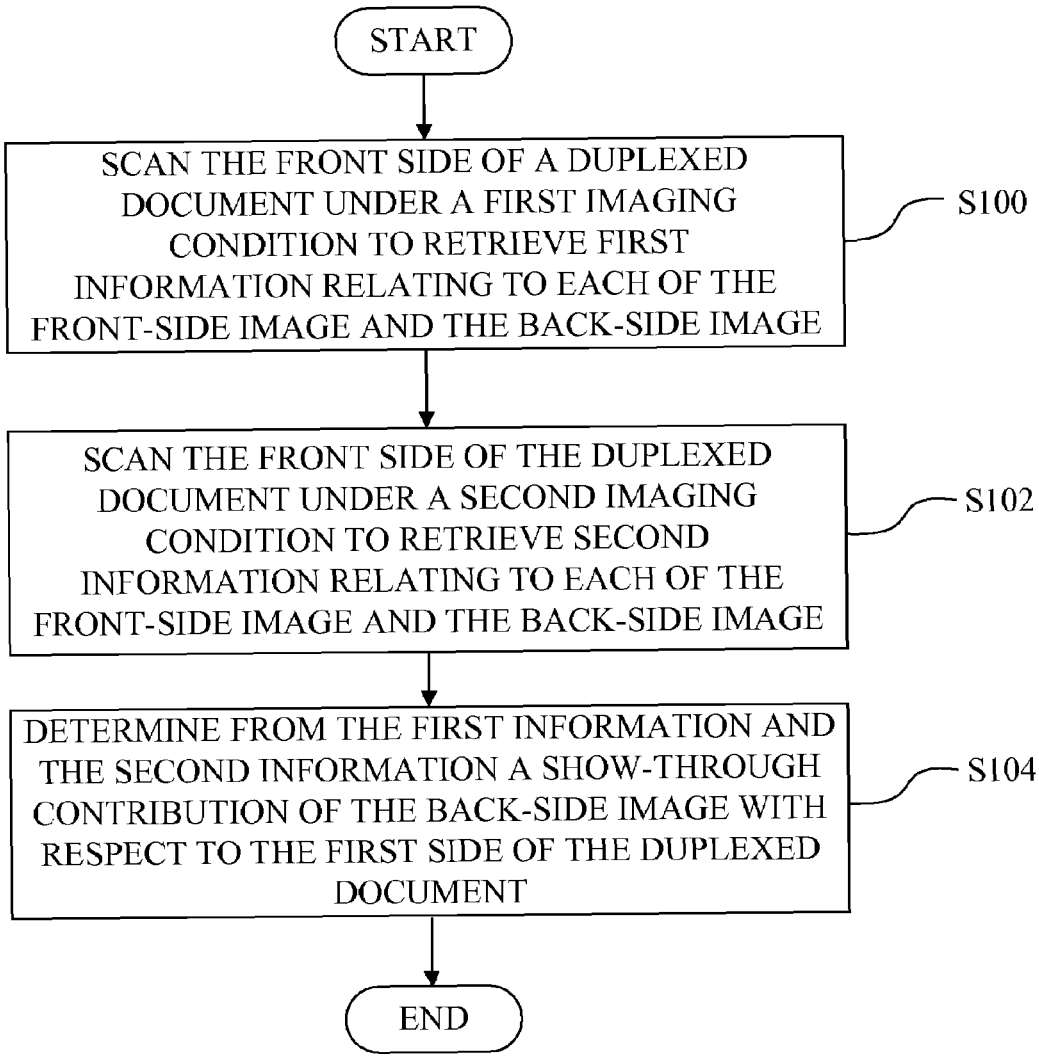
FIG. 3 is a flowchart of a method for processing a duplexed document to determine a show-through contribution of a back-side image with respect to a front side of the duplexed document using only single-side scanning of the duplexed document.

FIG. 3 is a flowchart of a method for processing a duplexed document to determine a show-through contribution of a back-side image with respect to a front side of the duplexed document using only single-side scanning of the duplexed document, and will now be described with further reference to FIGS. 4A-4C and 5. In summary, the present invention utilizes multiple scans of one side of a given duplexed document to generate dual scan data, and then compares the results to determine the likelihood of the presence of undesired information, i.e., a show-through contribution of the back-side image.

The method may be performed, for example, by imaging apparatus 12, such as an AIO unit, i.e., multifunction machine, either in a standalone mode or when operating in conjunction with host 14. As such, the steps of the flowchart of FIG. 3 may be performed by program instructions executed by controller 18 of imaging apparatus 12, or alternatively, by host 14 in conjunction with imaging apparatus 12.

In the method steps that follow, reference will be made to a first imaging condition and a second imaging condition. The following are examples of parameters that may be changed to achieve such first imaging condition and second imaging condition: illumination level, spectral characteristics, sensor sensitivities, backlighting levels, and lid background reflectance.

Also, for ease of understanding, referring to FIGS. 4A-4C, the method will be described with respect to a duplexed document 60 having a front side 62 and a back side 64. Printed on front side 62 is a front-side image 66, and printed on back side 64 is a back-side image 68.

At step S100, front side 62 of duplexed document 60 is scanned under a first imaging condition to retrieve first information relating to each of front-side image 66 and back-side image 68.

Figure 4A:
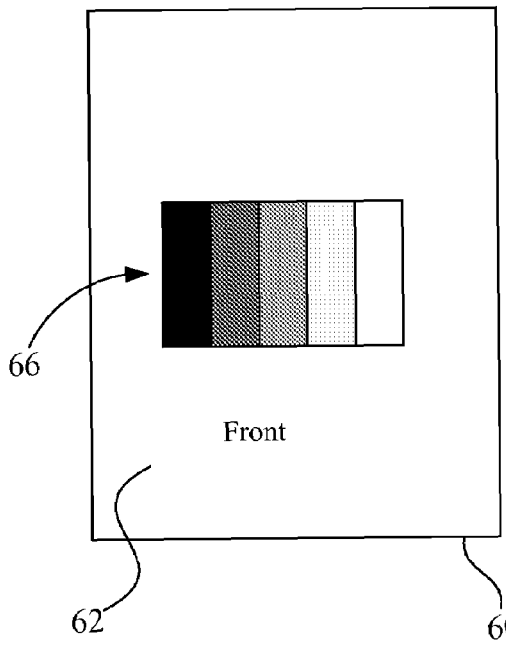
FIG. 4A shows a front-side image formed on a duplexed document.
Figure 4B:
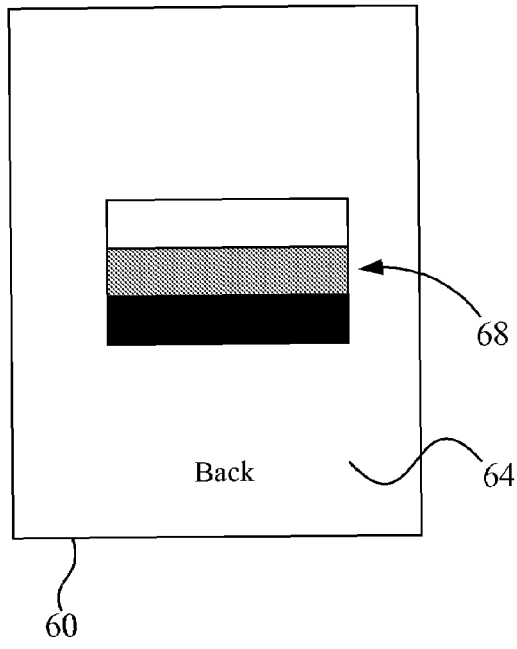
FIG. 4B shows a back-side image formed on the duplexed document of FIG. 4A.
Figure 4C:
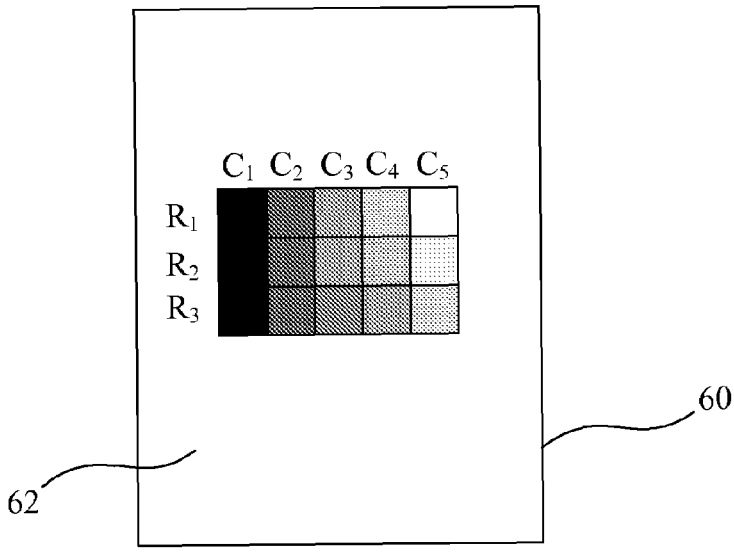
FIG. 4C illustrates, as viewed from the front side of the duplexed document, a show-through contribution of the back-side image of FIG. 4B to the front-side image of FIG. 4A of the duplexed document.

Referring to FIGS. 4A, 4B and 4C, front-side image 66 may be a first characterization pattern and back-side image 68 may be a second characterization pattern different from the first characterization pattern that is printed directly opposite to the first characterization pattern. The first characterization pattern of front-side image 66 has a plurality of regions and may be, for example, a plurality of parallel vertical bars, as shown in FIG. 4A, e.g., from left to right, black, dark gray, medium gray, light gray and white. The second characterization pattern of back-side image 68 has a plurality of regions and may be, for example, a plurality of parallel horizontal bars, as shown in FIG. 4B, e.g., from top to bottom, white, medium gray, and black.

FIG. 4C illustrates, as viewed from front side 62, a show-through contribution of the second characterization pattern formed on back side 64 that intersects the first characterization pattern of front-side image 66. In this example, the intersection results in a grid pattern. For ease of discussion, the rows of the grid pattern are labeled $R_1$, $R_2$, $R_3$, and the columns of the grid pattern are labeled $C_1$, $C_2$, $C_3$, $C_4$, $C_5$. Individual blocks will be referred to in the form of (Row, Column). Thus, the resulting show-through contribution of the horizontal bars of FIG. 4B on each of the vertical bars of FIG. 4A, is illustrated in FIG. 4C.

As shown in FIG. 4C, the vertical bars of front-side image 66 will be scanned as progressively darker from top to bottom due to the presence of darker bars from top to bottom on back-side image 68 of duplexed document 60. For example, as shown in FIG. 4C, in blocks $R_1$,$C_1$; $R_1$,$C_2$; $R_1$,$C_3$; $R_1$,$C_4$; and $R_1$,$C_5$, the white horizontal bar of back-side image 68 of FIG. 4B does not change the reflectivity of any of the vertical bars of front-side image 66, and as a result, along row $R_1$ the show-through contribution of back-side image 68 is negligible. In stark contrast, as shown in FIG. 4C, for example, in blocks $R_3$, $C_1$; $R_3$, $C_2$; $R_3$, $C_3$; $R_3$, $C_4$; and $R_3$, $C_5$, the black horizontal bar of back-side image 68 of FIG. 4B will change the reflectivity of (e.g., darken) the vertical bars of front-side image 66, particularly the light gray and white vertical bars, and as a result, the show-through contribution of back-side image 68 is significant along row $R_3$.

The "first information" relates to the reflectivity of the front-side image 66 and associated show-through contribution at each intersection of the show-through contribution of the plurality of horizontal bars of back-side image 68 with the plurality of vertical bars of front-side image 66.

Exemplary first information is shown in Table 1, below, as RGB reflectance data collected from a front-side scan of front side 62 of duplexed document 60. The entries in Table 1 correspond to the blocks in the grid of FIG. 4C under the first imaging condition, which in this example is with lid 54 of scanner unit 24 in the closed position.

TABLE 1

Collected RGB reflectance data of duplexed document 60 under the first imaging condition, e.g., conducting a front side scan and with scanner lid 54 closed.
Lid Closed

| | Front-side image | | | | |
|---|---|---|---|---|---|
| Back-side image | Black ($C_1$) | dark gray ($C_2$) | mid-gray ($C_3$) | light gray ($C_4$) | white ($C_5$) |
| white (row $R_1$) | 24 | 57 | 111 | 185 | 255 |
| gray (row $R_2$) | 23 | 55 | 109 | 174 | 247 |
| black (row $R_3$) | 22 | 53 | 108 | 173 | 246 |

At step S102, front side 62 of duplexed document 60 is scanned under a second imaging condition to retrieve second information relating to each of front-side image 66 and back-side image 68. The second information relates to reflectivity of the front-side image 66 and associated show-through contribution at each intersection of the show-through contribution of the plurality of horizontal bars of back-side image 68 with the plurality of vertical bars of front-side image 66.

Exemplary second information is shown in Table 2, below, as RGB reflectance data collected from a second front-side scan of front side 62 of duplexed document 60. The entries in Table 2 correspond to the blocks in the grid of FIG. 4C under the second imaging condition, which in this example is with lid 54 of scanner unit 24 in the open position.

TABLE 2

Collected RGB reflectance data of duplexed document 60 under the second imaging condition, e.g., conducting a front side scan and with scanner lid 54 opened.
Lid Opened

| | Front-side image | | | | |
|---|---|---|---|---|---|
| Back-side image | Black ($C_1$) | dark gray ($C_2$) | mid-gray ($C_3$) | light gray ($C_4$) | white ($C_5$) |
| white (row $R_1$) | 56 | 112 | 188 | 253 | 255 |
| gray (row $R_2$) | 43 | 89 | 147 | 222 | 255 |
| black (row $R_3$) | 20 | 68 | 120 | 186 | 252 |

At step S104, it is determined from the first information and the second information a show-through contribution of back-side image 68 with respect to front side 62 of duplexed document 60.

Figure 5:
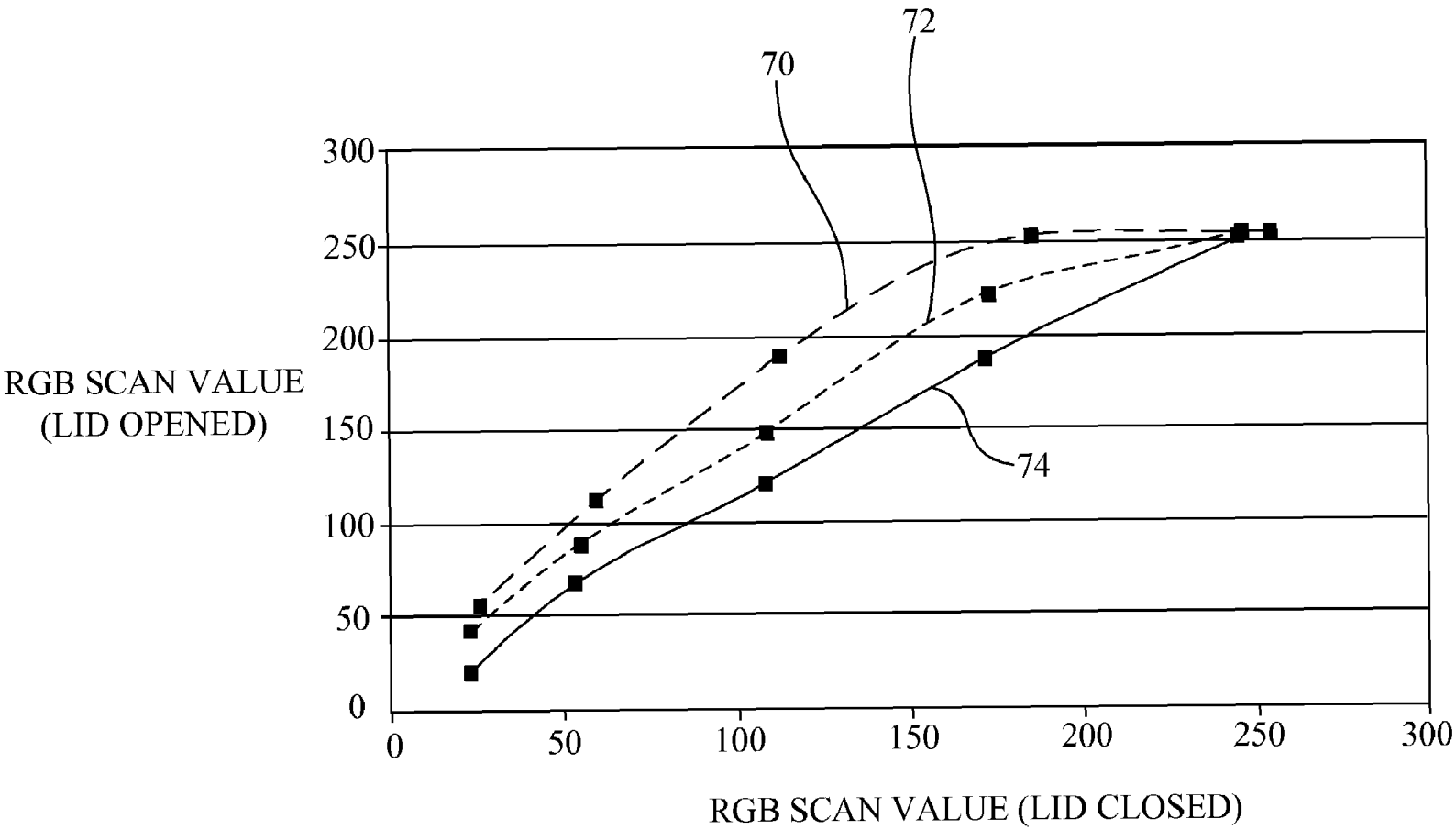
FIG. 5 is a graph that plots the collected RGB reflectance data of the duplexed document.

FIG. 5 is a graph that plots the collected RGB reflectance data of duplexed document 60 with a front-side scan and with scanner lid 54 closed (see Table 1) along the horizontal axis, versus the collected RGB reflectance data of duplexed document 60 with a front-side scan and with scanner lid 54 opened (see Table 2) along the vertical axis. Thus, the relationship between the two sets of data is exploited to provide useful discriminating information.

In FIG. 5, three curves are shown, each corresponding to a five block row, $R_1$, $R_2$, and $R_3$, respectively, shown in FIG. 4C, that includes the show-through contribution of back-side image 68 of FIG. 4B, e.g., the white, gray, and black horizontal bars. The curve corresponding to row R1, having a white back-side show-through pattern, is depicted by a widely spaced dashed line, and will be referred to as white curve 70. The curve corresponding to row R2, having a gray back-side show-through pattern, is depicted by a narrowly spaced dashed line, and will be referred to as gray curve 72. The curve corresponding to row R3, having a black back-side show-through pattern, is depicted by a solid line, and will be referred to as black curve 74.

Clearly, the white curve 70, gray curve 72 and black curve 74 are not coincident. Accordingly, the same side of an arbitrary document, e.g., document 58, can therefore be scanned under the two different illuminating conditions, and the resulting imaging information gray values used to determine the likelihood that the pixel is contaminated by show-through. For example, if the pair of scanned data for a given pixel plotted on the graph of FIG. 5 lies to the upper left of the white curve 70, the pixel is then judged to not be contaminated. However, if the pair of scanned data lies to the lower right of white curve 70, then image information contains some contamination. Furthermore, the precise location, in other words the relative proximity to gray curve 72 and/or black curve 74, relates to the relative degree of contamination.

Accordingly, the present invention may be used to remove the undesirable show-through contribution from the desired scanned information of a duplexed document to produce a more desirable scanned output.

In the example above, the two imaging conditions were based on the amount of backlighting, by having lid 54 of scanner unit 24 either closed or open. However, it is contemplated that the contrasting imaging conditions may be achieved by other techniques. For example, in one embodiment, the first imaging condition may include scanning at a first illumination level, and the second imaging condition may include scanning at a second illumination level different than the first illumination level. In another embodiment, the first imaging condition may include scanning with a first sensor having a first sensitivity, and the second imaging condition may include scanning with a second sensor having a second sensitivity different from the first sensitivity. In another embodiment, the first imaging condition may include scanning with a first illuminant having first spectral characteristics, and the second imaging condition may include scanning with a second illuminant having second spectral characteristics. In another embodiment, the second imaging condition may be varied from the first imaging condition by changing a reflectance or illumination characteristic of background 56 of scanner unit 24. For example, background 56 may have a phosphorescent surface capable of emitting light at various intensities, depending on the amount of charging of the phosphorescent surface by a light source, and the phosphorescent surface may be charged by selectively activating the illuminant of scanning bar 50 to charge the phosphorescent surface prior to positioning the document on document glass 52. In another embodiment, the second imaging condition may be varied from the first imaging condition by keeping lid 54 of scanner unit 24 open, while gating the illuminant ON and OFF at different regions of the document for each of the multiple scans. In another embodiment, either a backlight source or the illuminant of scanning bar 50 may be varied during a single scan of the front side of duplexed document 60, e.g., in an alternative fashion, to produce at least two distinct imaging conditions. Also, combinations of the examples identified above may be used.

Those skilled in the art will recognize that the number of imaging conditions may be increased beyond two, if desired, to collect additional data for use in practicing the invention.

Figure 6:
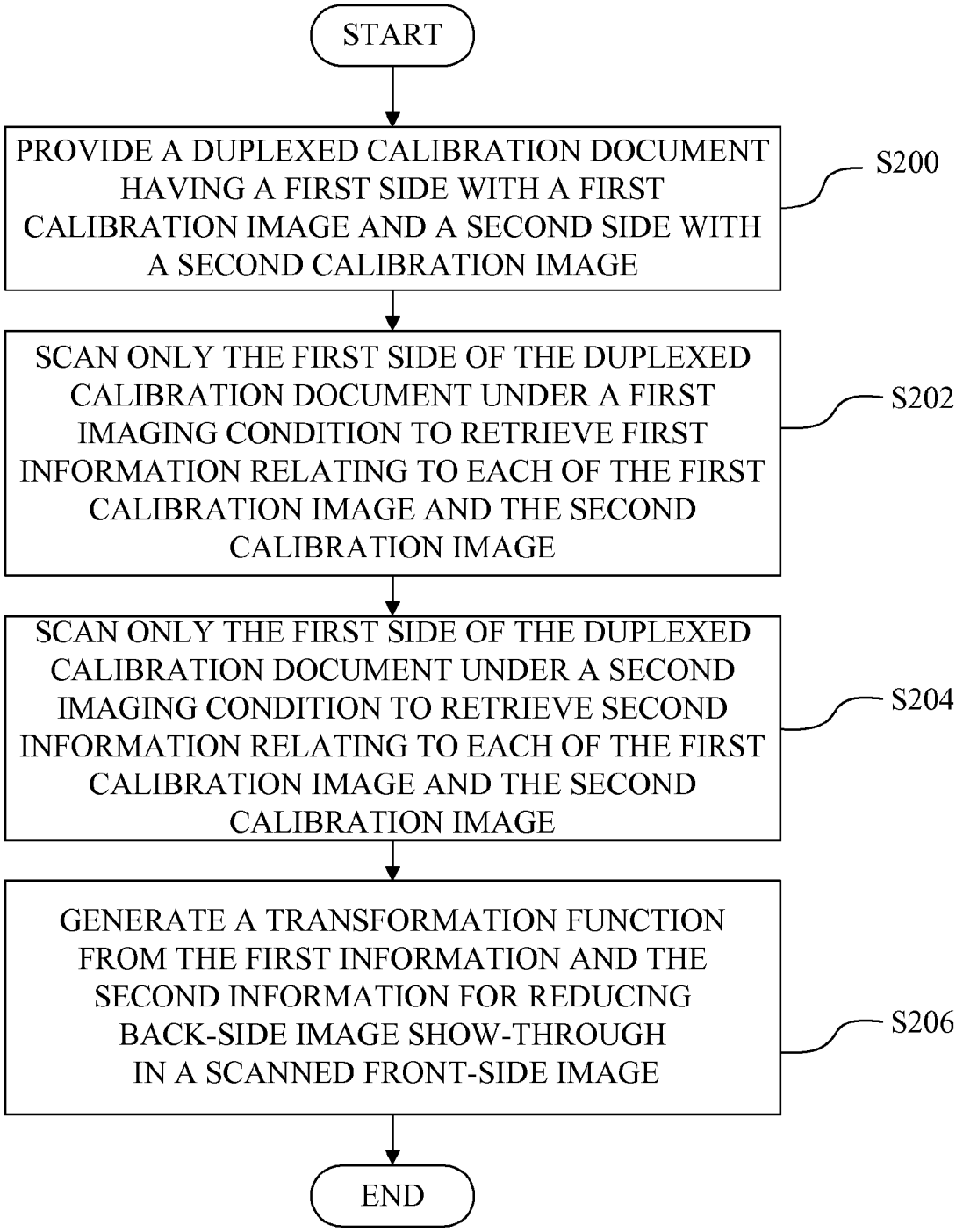
FIG. 6 is a flowchart of a method for calibrating a scanner for processing a duplexed user document, in accordance with an embodiment of the present invention.

FIG. 6 is a flowchart of a method for calibrating a scanner for processing a duplexed user document having a front side with a front-side image and a back side with a back-side image, in accordance with an embodiment of the present invention.

At step S200, a duplexed calibration document is provided having a first side with a first calibration image and a second side with a second calibration image. The duplexed calibration document may be, for example, the duplexed document 60 represented in FIG. 4C having a front side 62, e.g., the first side, with front-side image 66 and a back side 64, e.g., the second side, having back-side image 68. For example, duplexed calibration document 60 includes at least two patches representing the same color printed on front side 62 and has at least two patches having different contamination levels on back side 64, wherein the front side patches and the back side patches are arranged to be back-to-back on duplexed calibration document 60. In this example, one of the different contamination levels is a level of no contamination, i.e., row R1 of FIG. 4C.

At step S202, the process scans only the first side, e.g., the front side 62, of duplexed calibration document 60 under a first imaging condition to retrieve first information relating to each of said first calibration image and said second calibration image. For example, the first information may be grayscale values (R=G=B) associated with the first scan of front side 62, including show-through contribution from back-side image 68 under the first imaging condition. The first imaging condition may be, for example, any of those imaging conditions described above.

At step S204, the process scans only the first side, e.g., the front side 62, of duplexed calibration document 60 under a second imaging condition to retrieve second information relating to each of the first calibration image and the second calibration image. For example, the second information may be grayscale values (R=G=B) associated with the second scan of front side 62, including show-through contribution from back-side image 68 under the second imaging condition. The second imaging condition may be, for example, any of those imaging conditions described above not used as the first imaging condition.

At step S206, a transformation function is generated from the first information and the second information for reducing back-side image show-through in a scanned front-side image. Described in more detail below, the first information and the second information may be used to generate a "fix" matrix 78 corresponding to the transformation function.

Figure 7:
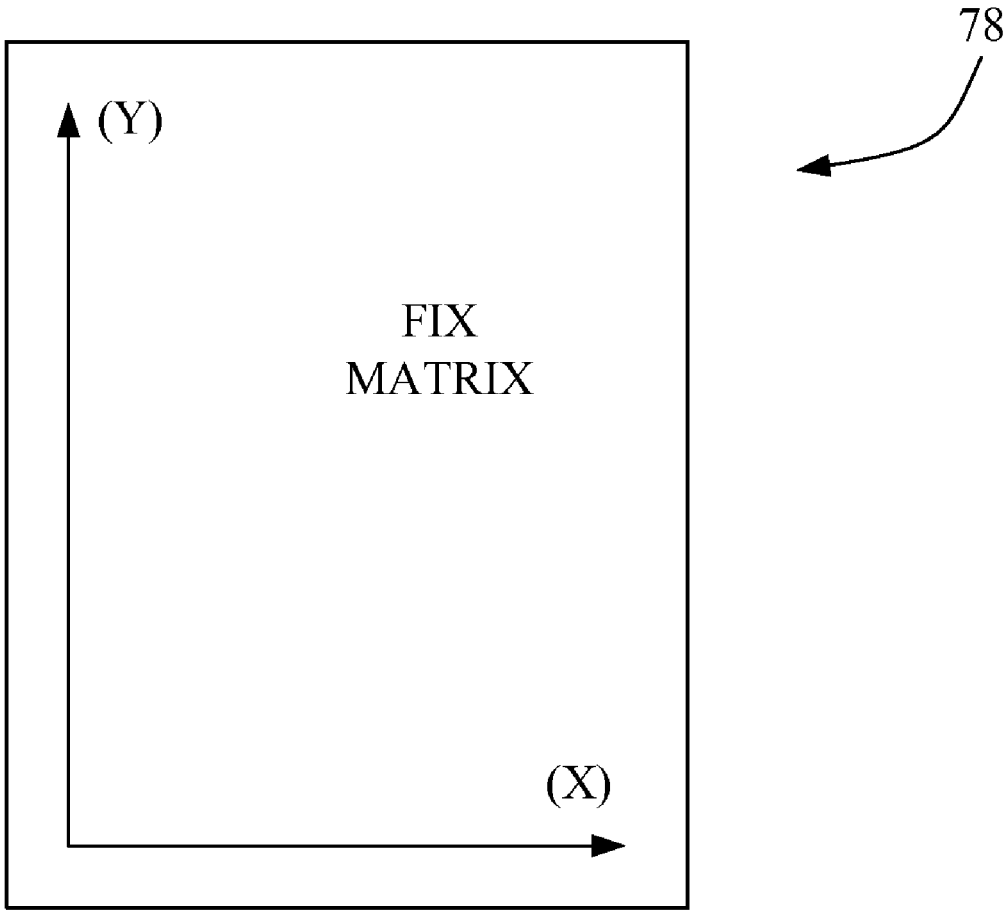
FIG. 7 is a diagrammatic representation of a fix matrix constructed in accordance with the method of FIG. 6.

Referring to FIG. 7, fix matrix 78 is constructed and utilized to reduce the show-through contribution of a back-side image with respect to a front side of the duplexed document in a scanned copy of the duplexed document. Fix matrix 78 may be, for example, a two-dimensional lookup table formed in a memory, such as memory 28 of imaging apparatus 12 or memory 40 of host 14, wherein two grayscale values obtained by scanning the same pixel of the duplexed document at two different imaging conditions are used to address the repair data contained in fix matrix 78.

Figure 8:
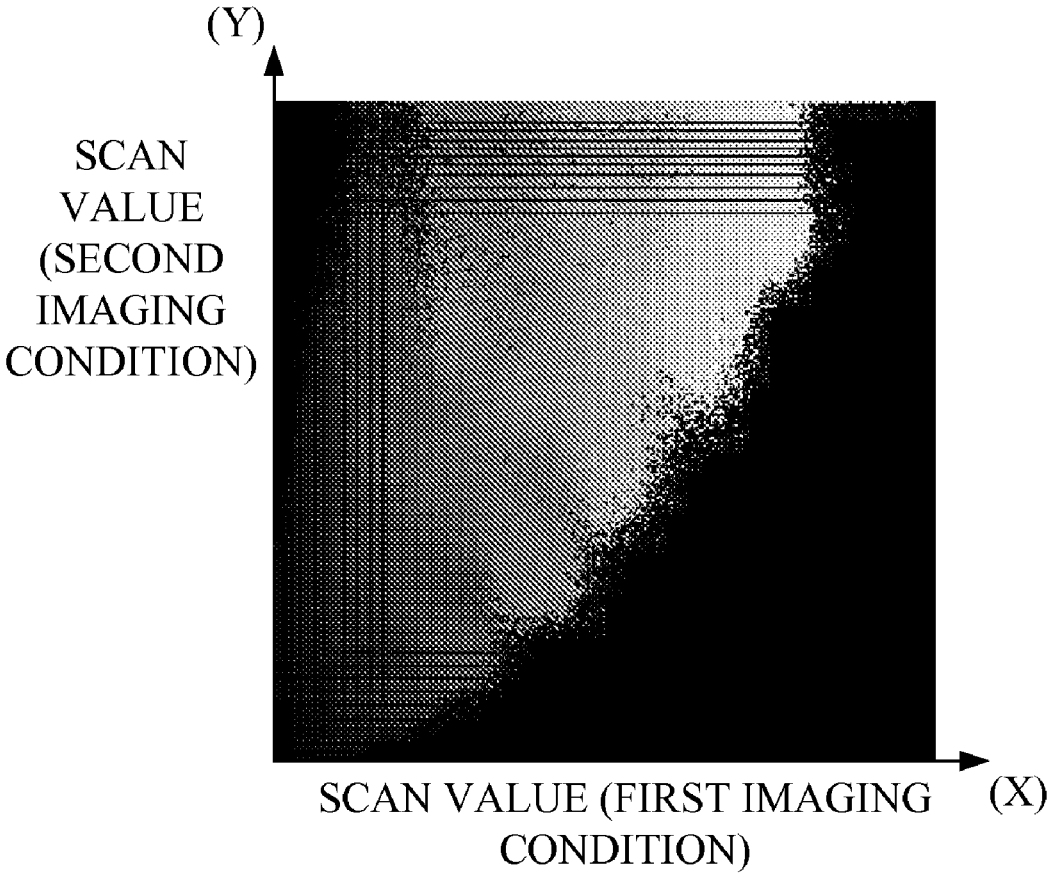
FIG. 8 is a graphical representation of the fix matrix of FIG. 7.

FIG. 8 is a graphical representation of the contents of fix matrix 78. Recall that in the example of FIG. 5, the locations of the 15 points of FIG. 5 were determined by averaging the gray values of the 15 calibration points illustrated in FIG. 4C that were scanned under two different imaging conditions. Also, recall that row R1 of FIG. 4C represented the ideal condition where there was no back side contribution to the scanned image, i.e., the top row of back-side image 68 was white (or blank) as shown in FIG. 4B. Thus, row R1 of FIG. 4C illustrates the scenario wherein the scanned front-side image 66 is uncontaminated by any back-side show-through contribution, whereas each of rows R2 and R3 illustrates a scenario wherein the scanned front-side image 66 is contaminated by back-side show-through contribution.

The points of FIG. 7 tend to form a cloud, indicating that the gray value from a scanner, rather than being uniform over a field of constant shade as in the example of FIG. 5, falls according to some distribution. Thus, instead of having only 5×3=15 points corresponding to the averages of the 15 calibration blocks as in the example of FIG. 5, there are many more points that are considered in the example illustrated in FIG. 7. Consider, for example, that each of the 15 calibration blocks in FIG. 4C may be subdivided into hundreds, or thousands, of sub-blocks. Thus, it should be recognized that a given two-dimensional pixel position (e.g., x-y position), may be covered from a scanned value from more than one of the calibration patches of FIG. 4C.

Thus, not only does the graphical data illustrated in FIG. 8 indicate the occurrence of a pixel in two-dimensional space from two calibration patches, but also indicates a repair value that can be used to construct an uncontaminated image from two scans of an uncalibrated duplexed user document under the same two imaging conditions used in determining the calibration targets. The graphical data illustrated in FIG. 8 is translated into fix matrix 78.

As mentioned above, row R1 of FIG. 4C illustrates the scenario wherein the scanned front-side image 66 is uncontaminated by any back-side show-through contribution, and rows R2 and R3 are contaminated by back-side show-through contribution. Therefore, for each of the five test shades (columns C1, C2, C3, C4, and C5 of FIG. 4C) at each of the two contamination levels illustrated of rows R2 and R3 of FIG. 4C, it is known what the shade should appear like if uncontaminated by considering values associated with the corresponding columns C1, C2, C3, C4, and C5 of row R1 of FIG. 4C, taken from a lid closed scan because users normally scan with the lid closed and the results of a lid closed scan are taken here as the "normal scan". In this example, each of the 15 calibration patches of FIG. 4C will be subdivided into a matrix of 150×150 pixels.

The following describes one exemplary algorithm for generating the repair values for fix matrix 78, as graphically illustrated in FIG. 8.

1. Allocate an array Sum[256][256], initialized to 0,
2. Allocate an array Count[256][256], initialized to 0.
3. For each of the 150×150 pixels of each of the 15 calibration patches of FIG. 4C, including the non-contaminated patches:
   a. obtain the scanned grayscale value "y" under a first imaging condition, e.g., from a lid-open scan, and the scanned grayscale value "x" under a second imaging condition, e.g., from the lid closed scan (see also, for example, FIG. 5).
   b. obtain a scanned grayscale value "Q" from the corresponding one of the 150×150 pixels of the corresponding one of the five test shades from the non-contaminated row R1 of the lid-closed scan.
   c. Add Q to Sum: Sum[Y][X]=Sum[Y][X]+Q
   d. Increment Count: Count[Y][X]=Count[Y][X]+1
4. Allocate an array FixMatrix[256][256] in memory.
5. Assign FixMatrix[q][r]=Sum[q][r]/Count[q][r] for q and r on the range 0 to 255, inclusive.

The method associated with utilizing fix matrix 78 may be in the form of executable program steps and reside in memory accessible by and executed by imaging apparatus 12 and/or host 14. For example, the utilization algorithm may reside, for example, in memory 28 and be executed by imaging apparatus 12, or may reside in memory 40 associated with host 14 and be executed by host 14.

Figure 9:
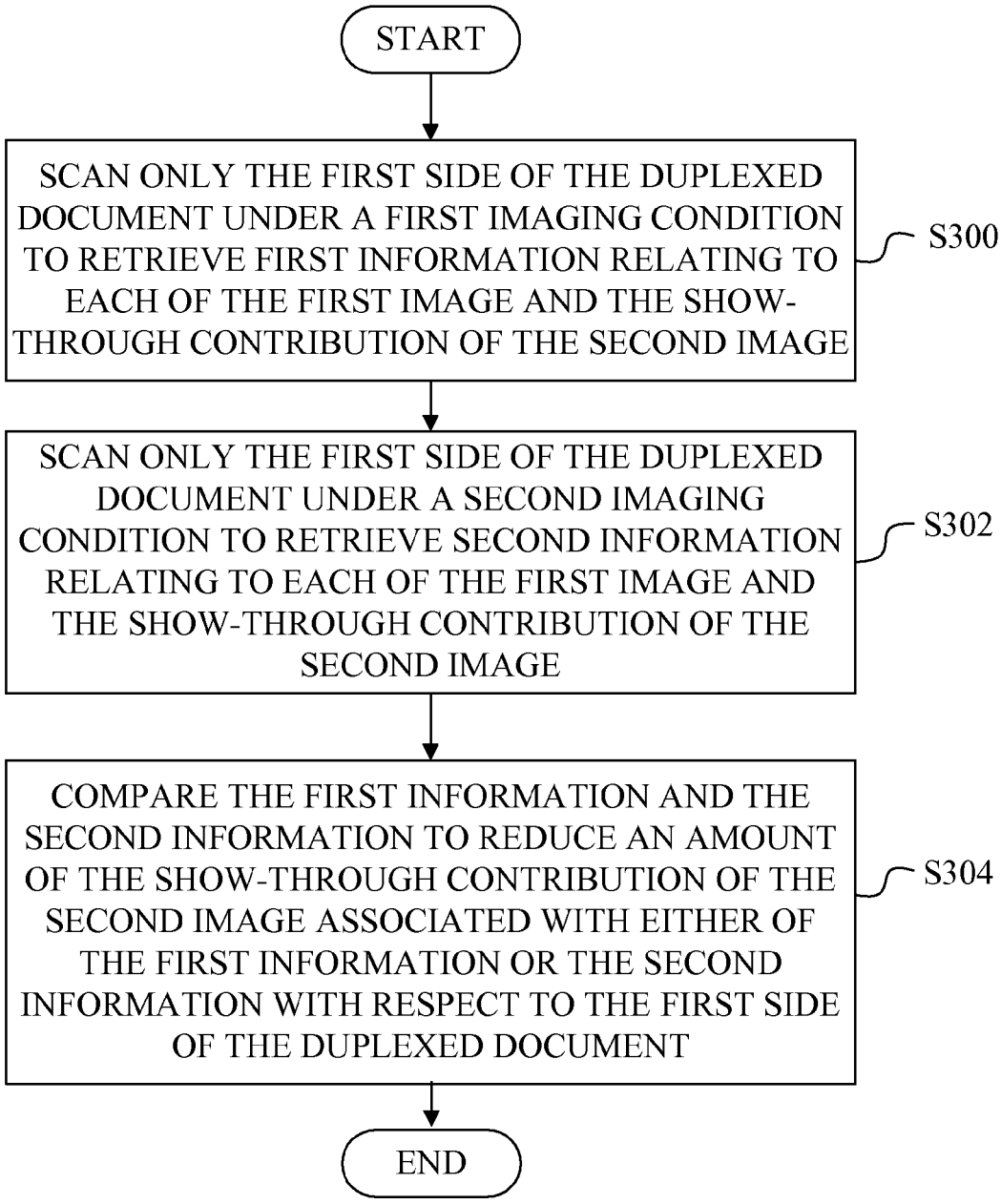
FIG. 9 is a flowchart of an exemplary method for processing a duplexed document having a first side with a first image and a second side with a second image, in accordance with an embodiment of the present invention.
Figure 10:
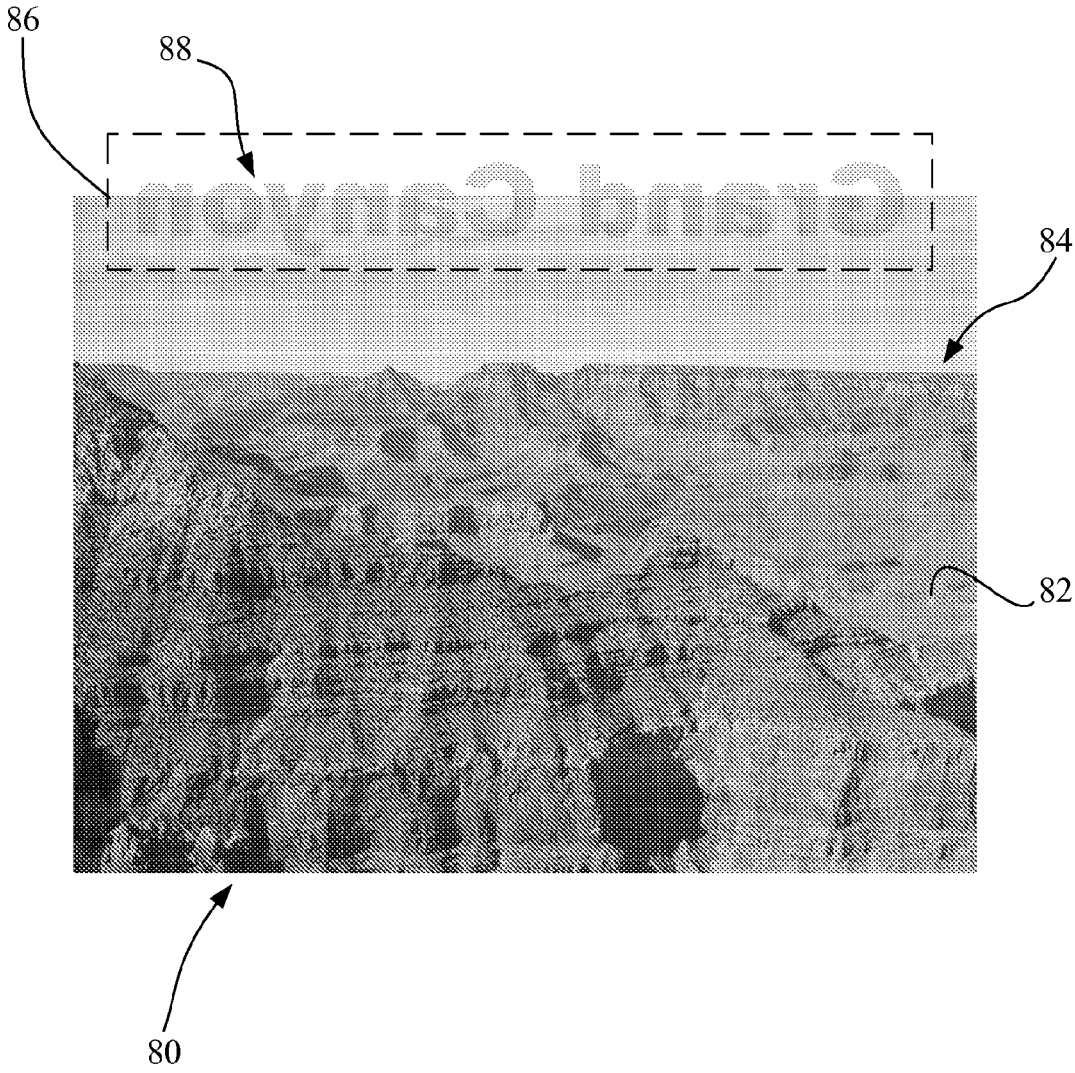
FIG. 10 is a pictorial representation of an exemplary scanned duplexed document having a back-side image contributing to a show-through contamination of a front-side image of the scanned duplex document.

FIG. 9 is a flowchart of an exemplary method for processing a duplexed document having a first side with a first image and a second side with a second image. FIG. 10 is a pictorial representation of an exemplary scanned duplexed document 80 having front side 82 having a front-side image 84 and a back side 86 having a back-side image 88, with back-side image 88 contributing to show-through contamination of front-side image 84. For ease of identification, back-side image 88 is surrounded by a dashed rectangular box, which is not part of back-side image 88.

At step S300, the process scans only the first side, e.g., front side 82, of duplexed document 80 under a first imaging condition to retrieve first information relating to each of the first image, e.g., front-side 82, and the show-through contribution of the second image, e.g., back-side image 88. The first imaging condition may be, for example, any of those imaging conditions described above that correspond to the imaging condition of step S202 of FIG. 6.

At step S302, the process scans only the first side, e.g., front side 82, of duplexed document 80 under a second imaging condition to retrieve second information relating to each of the first image, e.g., front-side 82, and the show-through contribution of the second image, e.g., back-side image 88. The second imaging condition may be, for example, any of those imaging conditions described above that correspond to the imaging condition used in step S204 of FIG. 6.

At step S304, the first information and the second information are compared to reduce an amount of the show-through contribution of the second image, e.g., back-side image 88, associated with either of the first information or the second information with respect to the first side, e.g., front side 82, of duplexed document 80.

This comparison may include, for example, using the first information relating to a particular pixel of the front-side image 84 and the second information relating to that same pixel of the front-side image 84 to retrieve a repair value for that particular pixel from the lookup table associated with fix matrix 78, and the process is repeated for each pixel in front-side image 84. For example, where the lookup table represents a two-dimensional fix matrix, and the first information and the second information may be used to index to a particular repair value in the lookup table representing fix matrix 78. By repeating the comparing step, the first information and the second information retrieve repair values from the lookup table representing fix matrix 78 to repair a copy of the front-side image 84 so as to, for example, reduce the show-through contribution of the back-side image 88 on the copy of the front-side image 84. An elimination of the show-through contribution of the back-side image 88 on the copy of the front-side image 84 is the desired amount of reduction, but may not be obtainable in all instances.

In other words, on a pixel-by-pixel basis, two scanned grayscale values (one from the first information and the other from the second information) generated under each of the two imaging conditions are used to index a two-dimensional location of fix matrix 78. The single value stored at the indexed location of fix matrix 78 is placed into the corresponding position of the repaired document, e.g., the copy of the front-side image 84. Once all pixels have been processed, the grayscale values corresponding to the first information and the second information are discarded, and the repaired document, having reduced show-through contamination, is presented to the user as the result of the scan operation.

Figure 11:
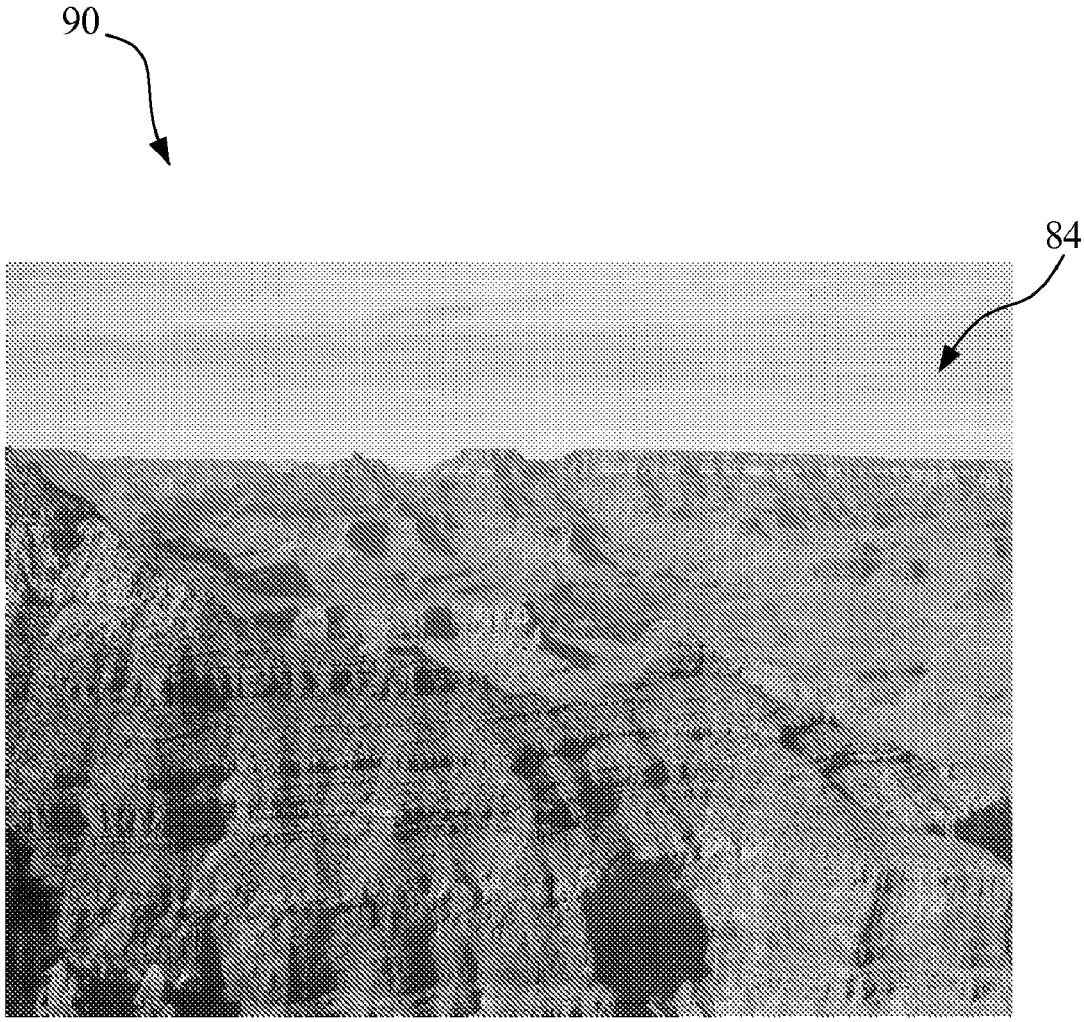
FIG. 11 is a pictorial representation of a printed result of application of the method of FIG. 9 to the scanned duplexed document of FIG. 10, showing the front-side image repaired to eliminate the show-through contribution of the back-side image.

FIG. 11 shows an exemplary printed result of application of the method of FIG. 9 to the scanned duplexed document 80 of FIG. 10 to form a front-side copy 90. In comparing FIG. 11 to FIG. 10, it can be seen that front-side image 84 has been repaired to reduce, e.g., in this case eliminate, the show-through contribution. i.e., contamination, of back-side image 88 from front-side image 84.

Accordingly, while this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for processing a duplexed document having a first side with a first image and a second side with a second image, comprising:

scanning only said first side of said duplexed document under a first imaging condition to retrieve first information relating to each of said first image and show-through contribution of said second image;

scanning only said first side of said duplexed document under a second imaging condition to retrieve second information relating to each of said first image and show-through contribution of said second image; and comparing said first information and said second information to reduce an amount of said show-through contribution of said second image.

2. The method of claim 1, wherein said comparing includes using said first information relating to a first pixel of said first image and said second information relating to said first pixel of said first image to retrieve a repair value for said first pixel from a lookup table.

3. The method of claim 2, wherein said lookup table represents a two-dimensional fix matrix, and said first information and said second information are used to index said fix matrix.

4. The method of claim 1, wherein said comparing includes using said first information and said second information to retrieve repair values from a lookup table to repair a copy of said first image.

5. The method of claim 4, wherein said lookup table represents a two-dimensional fix matrix, and said first information and said second information are used to index said fix matrix.

6. The method of claim 1, wherein said first imaging condition includes scanning with a first illumination, and said second imaging condition includes scanning with a second illumination different from said first illumination.

7. The method of claim 1, wherein said first imaging condition includes scanning with a first backlighting level, and said second imaging condition includes scanning with a second backlighting level.

8. The method of claim 7, wherein at least one of said first backlighting level and said second backlighting level is achieved by varying a light emission of a phosphorescent background positioned adjacent said second side of said duplexed document.

9. The method of claim 1, wherein said first imaging condition and said second imaging condition occur during a single scanning of said first side of said duplexed document.

10. The method of claim 1, wherein each of said first imaging condition and said second imaging condition is achieved with a lid of a scanner unit in an open position.

11. The method of claim 1, wherein said second imaging condition is varied from said first imaging condition by keeping a lid of a scanner unit open, while gating an illuminant of said scanner unit ON and OFF at different regions of said document for each said scanning of only said first side of said duplexed document.

12. A method for calibrating a scanner for processing a duplexed user document having a front side with a front-side image and a back side with a back-side image, comprising:

providing a duplexed calibration document having a first side with a first calibration image and a second side, opposite to said first side, with a second calibration image;

scanning only said first side of said duplexed calibration document under a first imaging condition to retrieve first information relating to each of said first calibration image and said second calibration image;

scanning only said first side of said duplexed calibration document under a second imaging condition to retrieve second information relating to each of said first calibration image and said second calibration image; and generating a transformation function from said first information and said second information for reducing back-side image show-through in a scanned front-side image.

13. The method of claim 12, wherein said duplexed calibration document includes at least two patches representing the same color printed on said first side of said duplexed calibration document and has at least two patches having different contamination levels on said second side of said duplexed calibration document.

14. The method of claim 13, wherein one of said different contamination levels is a level of no contamination.

15. The method of claim 12, further comprising using said first information and said second information to generate a lookup table corresponding to said transformation function.

16. The method of claim 12, wherein said first imaging condition includes scanning with a first illumination, and said second imaging condition includes scanning with a second illumination different from said first illumination.

17. The method of claim 12, wherein said first imaging condition includes scanning with a first backlighting level, and said second imaging condition includes scanning with a second backlighting level.

18. The method of claim 17, wherein said first backlighting level is achieved with a lid of a scanner unit closed and wherein said second backlighting level is achieved with said lid of said scanner unit open.

19. The method of claim 17, wherein at least one of said first backlighting level and said second backlighting level is achieved by varying a light emission of a phosphorescent background positioned adjacent said second side of said duplexed calibration document.

20. The method of claim 12, wherein said first imaging condition and said second imaging condition occur during a single scanning of said duplexed calibration document.

* * * * *

UNITED STATES PATENT AND TRADEMARK OFFICE

CERTIFICATE OF CORRECTION

PATENT NO. : 7,620,360 B2
APPLICATION NO. : 11/277882
DATED : November 17, 2009
INVENTOR(S) : Heydinger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 837 days.

Signed and Sealed this

Twenty-sixth Day of October, 2010

David J. Kappos

David J. Kappos
*Director of the United States Patent and Trademark Office*